United States Patent [19]

Cox et al.

[11] 4,397,034

[45] Aug. 2, 1983

BEST AVAILABLE COPY

[54] LOW PROBABILITY OF INTERCEPT TRANSMITTING APPARATUS

[75] Inventors: Benjamin V. Cox, Salt Lake City; Billie M. Spencer, Bountiful; John W. Zscheile, Jr., Murray, all of Utah

[73] Assignee: Sperry Corporation, New York, N.Y.

[21] Appl. No.: 247,686

[22] Filed: Mar. 26, 1981

[51] Int. Cl.[3] ..... H04K 1/00

[52] U.S. Cl. ..... 455/30; 455/26

[58] Field of Search ..... 455/26, 30, 1, 103; 375/1, 2.1, 2.2; 343/18 E

[56] References Cited

U.S. PATENT DOCUMENTS

| | | | |
|---|---|---|---|
| 2,400,950 | 5/1946 | Porington | 455/30 |
| 2,413,396 | 12/1946 | Weagent | 455/30 |
| 2,660,666 | 11/1953 | Duckett et al. | 455/30 |
| 3,638,121 | 1/1972 | Spilker | 455/30 |
| 3,879,732 | 4/1975 | Simpson | 343/18 E |
| 4,143,375 | 3/1979 | Knopf | 348/18 E |
| 4,176,316 | 11/1979 | De Rosa et al. | 455/26 |
| 4,324,002 | 4/1982 | Spilker | 455/26 |

*Primary Examiner*—Sal Cangialosi

*Attorney, Agent, or Firm*—John B. Sowell; Kenneth T. Grace; Marshall M. Truex

[57] ABSTRACT

A system for transmitting desired information is provided which has a very low probability of being intercepted. The system combines a well known narrow bandwidth directional antenna for limiting the interception of the main beam information signal with a novel random noise generated signal which guarantees that the sidelobe signals which also contain the desired information cannot be distinguished as information signals.

7 Claims, 2 Drawing Figures

LOW PROBABILITY OF INTERCEPT TRANSMITTING APPARATUS

BACKGROUND OF THE INVENTION

1. Field of the Invention

This invention relates to apparatus for preventing the interception of transmitted data. More particularly, the present invention system may be employed to guarantee that data being transmitted on a directional antenna cannot be intercepted, except when the intercepting means are located directly in the main directional beam.

2. Description of the Prior Art

The problem of limiting or eliminating interception of transmitted signals is well known, and various attempts have been made to eliminate the problem.

It is well known that persons unfriendly to the United States have developed intercept techniques for intercepting, receiving and decoding transmitted sensitive data. The decoded data may be analyzed for information content, and the source and direction may be recorded for locating the transmitting source in order to direct homing devices against the source and/or to direct countermeasure devices against the transmitting source.

When the unfriendly party is able to interpose a receiving device intermediate the friendly transmitter and the remotely located friendly receiver, he is able to intercept the transmitted data. Transmitting systems have been developed which utilize transmitting antennas having main direction beam width less than one degree in cone angle width. Such systems employ line of sight frequencies and limit main beam interception to a very narrow range of altitude and direction. These systems have forced unfriendly parties to direct their intercept efforts to intercepting the data signal present in the sidelobe signals.

Prior art systems have attempted to reduce the sidelobe signals by redesigning the transmitting antenna and/or providing tapered antennas which reduce, but do not eliminate, the sidelobe data signals.

Prior art systems have employed absorbent materials around portions of the directional antenna to attenuate the magnitude of the sidelobe data signal.

The inventors of the present subject matter have analyzed numerous proposed systems for reducing the magnitude of the sidelobe signals from a directional antenna and have concluded that reduction of sidelobe gain merely forces the intercepting party to place his receiver closer to the transmitting apparatus or to develop more sensitive receiving intercept equipment in order to recover the attenuated sidelobe signals.

It would be extremely desirable to provide a transmitting system that guarantees that an unfriendly party cannot intercept transmitted data signals from sidelobe signals independent of the distance between the unfriendly receiver and the directional transmitting antenna.

SUMMARY OF THE INVENTION

It is a principal object of the present invention to provide a low probability of intercept (LPI) transmitting apparatus.

It is yet another principal object of the present invention to provide a directional antenna transmitting system in which the sidelobe signal cannot be intercepted.

It is another principal object of the present invention to provide a narrow beam width directional antenna transmitting system having an area surrounding the transmitting source in which no sidelobe data information can be intercepted.

It is a general object of the present invention to prevent the reception of the true data signal by spoofing receiving and transmitting systems.

It is yet another object of the present invention to provide means for generating an omni-directional secondary signal which permits proper data reception within the main beam and inhibits reception of the sidelobe beam signals.

According to these and other objects of the present invention to be discussed in greater detail hereinafter, there is provided a data source for providing a modulated information signal to be transmitted on a narrow beam width directional antenna of the type which also generates sidelobe signals containing the information signal. Further, there is provided a colocated omni-directional antenna supplied with a random signal which is designed to completely mask and overcome the sidelobe signal without interfering with the modulated information signal being transmitted to a remote receiver.

DESCRIPTION OF THE PREFERRED EMBODIMENT

Figure 1:
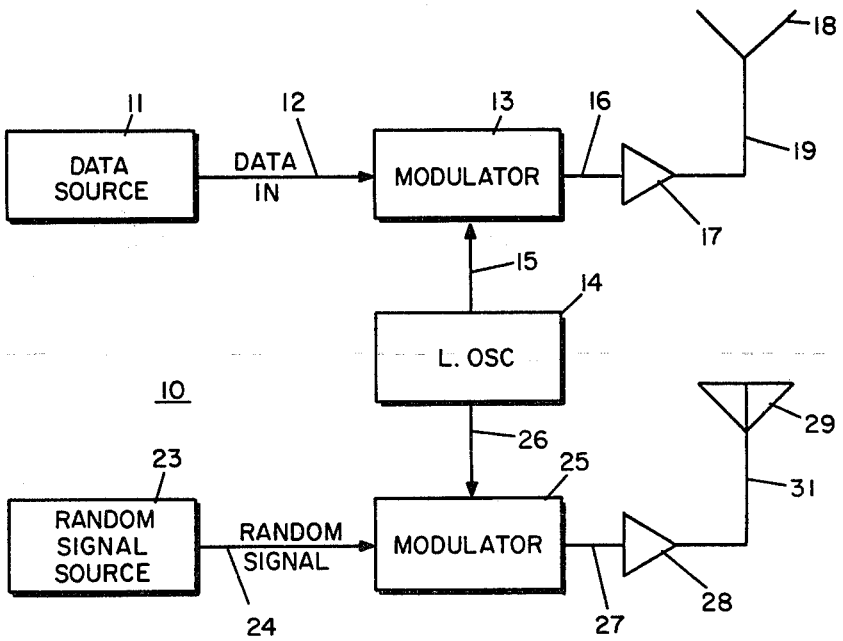
FIG. 1 is a simplified schematic block diagram of the present invention LPI transmitting system.

Refer to FIG. 1 showing a preferred embodiment LPI transmitting system 10. A source of data 11 provides digital or analog information signals in a desired form.

The data on line 12 is transmitted to modulator 13 to modulate the signal from local oscillator 14 which is on line 15. The data modulated carrier frequency signal on line 16 provides a main modulated data signal which is applied to amplifier 17 and to antenna 18 via line 19.

Figure 2:
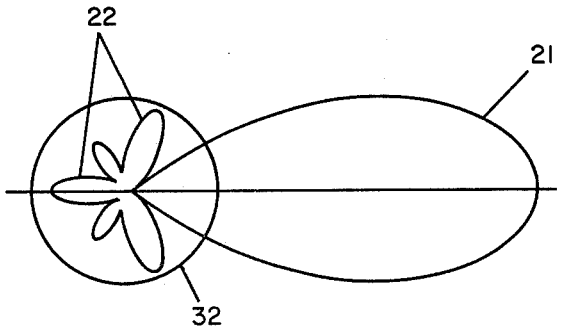
FIG. 2 is a schematic antenna gain diagram adapted to illustrate the mode of operation of the present invention.

Directional antenna 18 is preferably provided with a narrow beam high gain main beam signal 21 as shown in FIG. 2. The signal from antenna 18 also comprises an undesired sidelobe signal 22 which is of much lower gain than the main beam 21. It will be understood that the schematic representations of the beam signals in FIG. 2 are exaggerated to better illustrate the invention and that the main beam signal 21 is preferably one degree in beam width or less and provides a gain of greater than 40 db. over an isotropic gain pattern. The undesirable sidelobe signals 22 occur outside of the main beam 21 and are reduced to at least 20 db. below the main beam gain.

A random signal source 23 provides a random noise signal which obeys the same statistical properties as the data source 11, however, the random signal is preferably independent of the data source and has no correlation whatsoever with the data source 11. If the data source 11 has a digital output, the random signal source 23 is provided with a digital output at the same digital rate as the data source 11. If the data source 11 has an analog output signal, then the random signal source 23 also is provided with a random analog signal output which has the same voltage range as the data source.

The random noise signals on line 24 are applied to modulator 25 to modulate the signals from local oscillator 14 on line 26 to provide random modulated masking signals on line 27. The random modulated masking signals on line 27 are amplified in amplifier 28 and are applied to antenna 29 via line 31. Omni-directional antenna 29 has a uniform gain pattern in all directions as schematically shown in FIG. 2 where the uniform antenna pattern 32 is shown masking the sidelobe pattern 22. As long as the transmitted isotropic power from the omni-directional antenna 29 is greater than the maximum transmitted sidelobe power 22, then the data contained in the sidelobe signal 22 is immune from accurate demodulation.

Stated differently the intercepted signal to noise ratio comprises the ratio of the signal strength of signal 22 to the masking signal 32, thus, the signal to noise (S/N) ratio is less than zero db.

By providing masking signal 32 with the same statistical properties as the sidelobe signal 22, it can be guaranteed that the sidelobe data signals 22 cannot be discriminated from the random noise masking signal 32.

Having explained a preferred embodiment of the present invention, it would be understood that other modified forms of masking signals 32 can be generated in an attempt to mask the sidelobe signal 22. However, there is no guarantee that such modified masking signals will actually mask the signal 22 even if the power of the masking signal is increased to the point where it begins to interfere with the main beam data signal 21.

In the present embodiment system, eavesdropping and sidelobe interception of both digital and analog signals can be prevented. Thus, the present invention may be embodied in both military apparatus as well as commercial telephone links which employ antenna transmitted information. The apparatus is effective even when the omni-directional antenna is located in the area near the main directional antenna as distinguished from being absolutely colocated, thus, the term as used herein embraces near proximity.

Since the present apparatus invention is capable of preventing the interception of undesirable sidelobe signals, it may be employed to prevent spoofing systems from receiving the information necessary for them to generate false and misleading signals.

Having explained that the effective mask signal may be produced when the omni-directional antenna is located in the near proximity to the main directional beam antenna, another feature of the present invention may be explained. The omni-directional antenna may be a plurality of omni-directional antennas generating the masking signal at points near enough to accomplish effective masking of the sidelobe signal 22. Now the masking signal, which is stronger than the sidelobe signal, serves as a decoy against any anti-radiation missiles homing on source because they will be homing on the omni-directional antennas which are only close to the main directional beam source.

It will be understood that any reception outside of the main beam signal 21 will be from the omni-directional antennas, thus, providing effective protection and decoys for the main beam station as well as masking the sidelobe signal 22.

We claim:

1. A low probability of intercept transmitting apparatus, comprising:

a source of data information, a local oscillator adapted to provide a carrier frequency, a first modulator coupled to said local oscillator and to said data information for providing a main modulated data signal, a directional antenna coupled to said main modulated data signal for transmitting main data signals and producing a desirable main beam signal and undesirable sidelobe signals, a source of random noise signals having the same statistical waveform characteristics as said data information, a second modulator coupled to said local oscillator and to said random noise signals for providing a random modulated masking signal, and an omni-directional antenna colocated with said directional antenna for transmitting said masking signal and for masking said sidelobe signals.

2. A low probability of intercept transmitting apparatus as set forth in claim 1 which further comprises:

a first amplifier coupled between said first modulator and said directional antenna, a second amplifier coupled between said second modulator and said omni-directional antenna, said second amplifier providing an output signal on said omni-directional antenna which is greater than the maximum sidelobe signal, whereby the signal to noise ratio of said sidelobe signal to said masking signal is less than zero decibels.

3. A low probability of intercept transmitting apparatus as set forth in claim 2 wherein the output from said first amplifier multiplied by the gain of said main beam signal from said directional antenna provides adequate signal strength to accommodate a remote receiver.

4. A low probability of intercept transmitting apparatus as set forth in claim 2 wherein the output from said second amplifier multiplied by the gain of said omni-directional antenna is less than the main beam signal and greater than the maximum undesirable sidelobe signal.

5. A low probability of intercept transmitting apparatus as set forth in claim 1 wherein said data source provides coded digital signals and said random signal source provides means for independently generating random signals which emulate said coded digital signals.

6. A low probability of intercept transmitting apparatus as set forth in claim 1 wherein said omni-directional antenna includes a plurality of omni-directional antennas.

7. A low probability of intercept transmitting apparatus as set forth in claim 6 wherein said plurality of omni-directional antennas are placed in the near proximity to said directional antenna to serve as decoy sources.

* * * * *